US008608941B2

(12) United States Patent
Haizmann et al.

(10) Patent No.: US 8,608,941 B2
(45) **Date of Patent: *Dec. 17, 2013**

(54) REFORMING PROCESS WITH INTEGRATED FLUID CATALYTIC CRACKER GASOLINE AND HYDROPROCESSED CYCLE OIL

(75) Inventors: Robert Haizmann, Rolling Meadows, IL (US); Laura E. Leonard, Western Springs, IL (US)

(73) Assignee: UOP LLC, Des Plaines, IL (US)

( * ) Notice: Subject to any disclaimer, the term of this patent is extended or adjusted under 35 U.S.C. 154(b) by 158 days.

This patent is subject to a terminal disclaimer.

(21) Appl. No.: 13/268,883

(22) Filed: Oct. 7, 2011

(65) Prior Publication Data

US 2013/0087482 A1 Apr. 11, 2013

(51) Int. Cl.
*C10G 55/06* (2006.01)
*C10G 55/02* (2006.01)

(52) U.S. Cl.
USPC ..... 208/69; 208/60; 208/49; 585/313; 585/805

(58) Field of Classification Search
USPC ..... 208/49, 60, 69; 585/313, 805
See application file for complete search history.

(56) References Cited

U.S. PATENT DOCUMENTS 4,417,973 A 11/1983 Angevine et al.
4,606,816 A 8/1986 Harandi
4,789,457 A 12/1988 Fischer et al.
5,271,851 A 12/1993 Nelson et al.
5,310,477 A 5/1994 Lomas
5,837,130 A 11/1998 Crossland
5,944,982 A 8/1999 Lomas
6,113,776 A 9/2000 Upson
6,900,365 B2 5/2005 Chen et al.
2010/0230324 A1 9/2010 Al-Alloush et al.
2010/0243527 A1 9/2010 Lomas et al.
2010/0331589 A1 12/2010 Zimmermann et al.

OTHER PUBLICATIONS

Laird, D., Fractionation impact on FCC gasoline and LCO sulfur content, NPRA Annual Meeting Papers, v 2002, 16p, 2002; Conference: 2002 Annual Meeting—National Petrochemical and Refiners Association, Mar. 17, 2002-Mar. 19, 2002.

De Rezende Piniio, A.; Gilbert, W.R.; Montaury, Pimenta, R.D. , Influence of feed hydrotreatment on FCC product aromatics, 2004 AIChE Spring Meeting, Conference Proceedings, 2004; ISBN-10: 0816909423; Conference: 2004 AIChE Spring Meeting, Conference Proceedings, Apr. 25, 2004-Apr. 29, 2004; Sponsor: American Institute of Chemical Engineers, AIChE.

*Primary Examiner* — Thuan D Dang
(74) *Attorney, Agent, or Firm* — Mark R Willis

(57) ABSTRACT

A reforming process includes integrating catalytic cracking product naphtha dehydrogenation and naphtha from a hydrocracking zone and feeding them to a dehydrogenation zone. The dehydrogenation zone includes a first portion of reforming catalyst from a catalyst regenerator that moves downward through the dehydrogenation zone. A product stream from the dehydrogenation zone flows to an aromatics unit and is separated into an aromatic-rich extract and a raffinate. Straight run naphtha and the raffinate are introduced to a first reforming zone that includes a second portion of reforming catalyst. The reforming catalyst moves through the first reforming zone then is removed from the bottom of each of the first reforming zone and the dehydrogenation zone and is fed to a second reforming zone. An effluent from the first reforming zone is fed to a plurality of reforming zones. The reforming catalyst moves downward through the multiple reforming zones then to a regenerator.

9 Claims, 1 Drawing Sheet

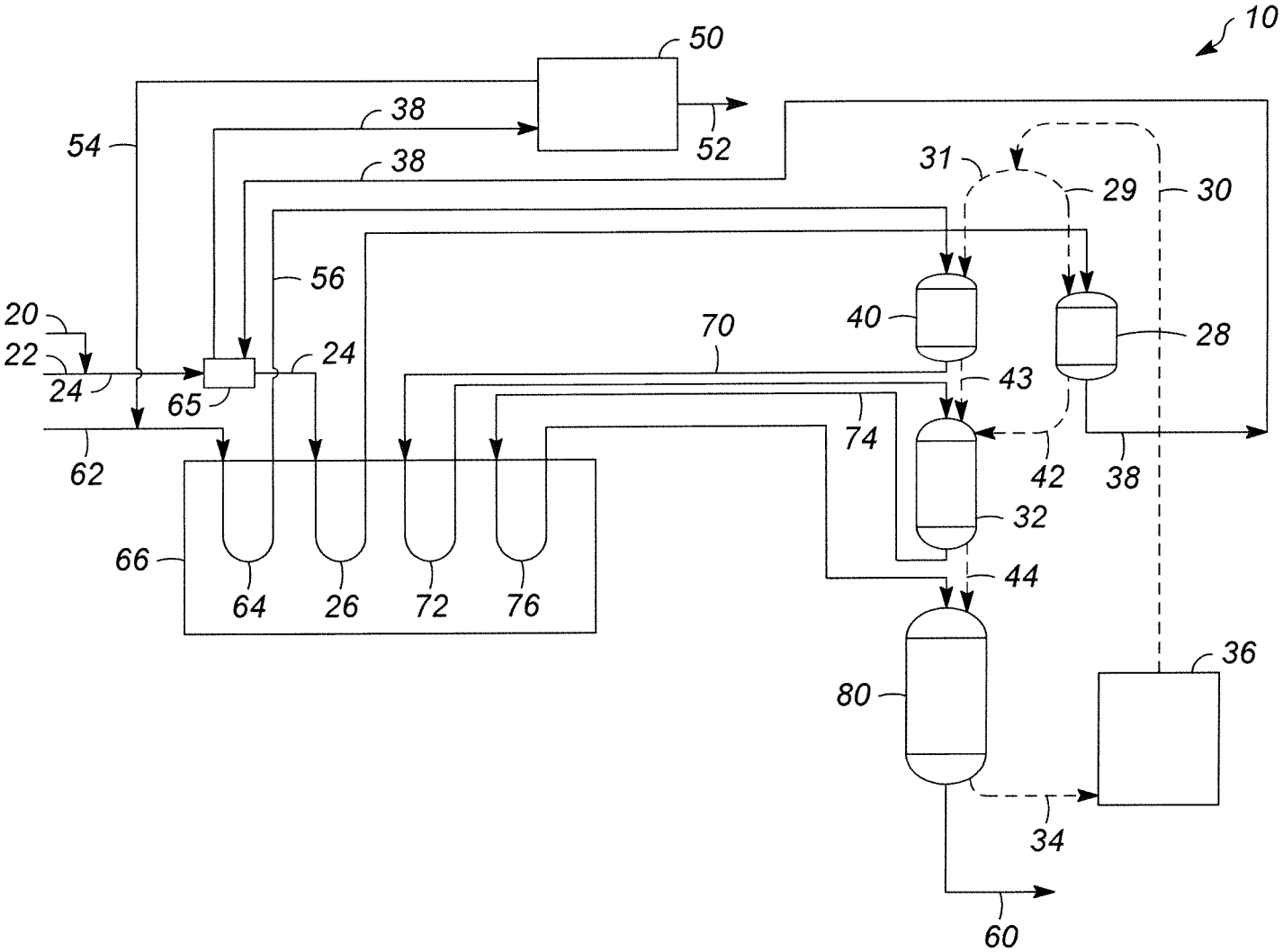
10
30
28
36
29
38
42
34
31
43
32
44
60
40
74
80
70
50
52
76
72
38
38
26
56
24
64
65
66
54
62
24
20
22

REFORMING PROCESS WITH INTEGRATED FLUID CATALYTIC CRACKER GASOLINE AND HYDROPROCESSED CYCLE OIL

CROSS REFERENCE TO RELATED APPLICATIONS

This application is related to U.S. Ser. Nos. 13/269,075, and 13/269,096, each filed concurrently herewith and herein incorporated by reference.

BACKGROUND OF THE INVENTION

A modern refinery is an integrated complex designed to utilize as much of the crude oil as possible. A distillation tower divides the crude into a plurality of cuts by boiling point range. Depending on the properties of the crude, some of these cuts are usable without further processing. However, most of the streams from the distillation tower are treated to change one or more of its properties. For example, impurities, such as sulfur or nitrogen, are reduced in cuts destined for burning. It is beneficial to increase the octane in cuts that will be used in the gasoline pool. Heavy cuts, which are generally lower in value, can be converted into lighter, more profitable cuts by catalytic cracking. The fluid catalytic cracking unit, or "FCC unit," for example, converts virgin gas oil to gasoline and light cycle oil.

Further, demand for various petroleum products varies over time. In the summer, gasoline and jet fuel are in demand during the travel season. During the winter, more heating and fuel oil is used than during the warm summer months. Changes in technology often produce a shift in demand for oil products. Thus, it is also important that a refinery be able to vary the relative amounts of the products to meet these changing demands.

Complexities of the refinery often lead to inefficiencies and duplication of units. There are often several hydrotreaters for removal of impurities. The hydrotreaters may operate at different process conditions or using different catalysts depending on the quality or boiling point range of the feedstock. It would be beneficial if at least some of the refinery processes could be combined into an integrated process to more efficiently utilize process equipment available in the refinery.

SUMMARY OF THE INVENTION

At least some of the inefficiencies of a refinery are overcome by the integrated flow scheme that provides for efficient integration of a dehydrogenation zone with a catalytic reforming zone and an aromatics recovery unit. More specifically, a method of integrating fluid catalytic cracking product naphtha dehydrogenation with catalytic reforming includes heating a naphtha from a hydrocracking zone and naphtha from a fluid catalytic cracking zone and feeding them to a dehydrogenation zone, the dehydrogenation zone comprising a first portion of regenerated reforming catalyst from a catalyst regenerator. The regenerated reforming catalyst moves downward through the dehydrogenation zone in a moving bed as it starts to become lightly coked catalyst. A product stream from the dehydrogenation zone flows through a heat exchanger then to an aromatics extraction unit. At the aromatics extraction unit, an aromatic-rich extract is withdrawn from the dehydrogenation product stream with a raffinate having the remainder of the dehydrogenation zone components.

Straight run naphtha and the raffinate are heated prior to introduction to a first reforming zone, the first reforming zone comprising a second portion of regenerated reforming catalyst from the catalyst regenerator. The regenerated reforming catalyst moves downwardly through the first reforming zone as it starts to become a lightly coked catalyst. The lightly coked catalyst is removed from the bottom of each of the first reforming zone and the dehydrogenation zone and is fed to the top of the second reforming zone. An effluent from the first reforming zone is heated and fed to a second reforming zone. The lightly coked reforming catalyst moves downward through the second reforming zone as it becomes partially coked reforming catalyst;

The partially coked reforming catalyst is removed from the second reforming zone and fed to a third reforming zone. Meanwhile, an effluent from the second reforming zone is heated and fed to the third reforming zone where it contacts the partially spent reforming catalyst. The moving bed system moves the partially spent reforming catalyst downwardly through the third reforming zone as it becomes a substantially spent catalyst. At the bottom of the third reforming zone, the substantially spent reforming catalyst is removed from the third reforming zone and regenerated in the catalyst regenerator.

The novel idea of this invention is a more efficient way to make use of these FCC naphtha and LCO streams as feedstock to an aromatics complex to maximize the yield of p-Xylene and Benzene. If aromatics production is desired from these streams, the traditional practice is to process FCC naphtha and LCO separately. Separate fractionation, hydrotreating and extraction are required. This invention discloses an integrated scheme which dramatically improves yields and decreases capital cost.

DETAILED DESCRIPTION OF THE DRAWING

The Figure is a flow diagram of an integrated flow scheme including one embodiment of the invention.

DETAILED DESCRIPTION OF THE INVENTION

The Figure shows the flow diagram for a reforming process, generally 10, integrated with naphtha from a catalytic cracking unit and naphtha from a hydrocracking zone. In the figure, solid lines depict the hydrocarbon streams while the dashed lines represent catalyst movement.

A method of integrating fluid catalytic cracking feedstock dehydrogenation with catalytic reforming 10 begins with naphtha products from a fluidized catalytic cracker ("FCC") 20 and a hydrocracker 22. For the purposes of this invention, a hydrocracker is a processing zone where a hydrogen-containing treat gas is used in the presence of suitable catalysts that are primarily active for the removal of heteroatoms, such as sulfur and nitrogen.

Naphtha from hydrocracking zones 22 and naphtha from FCC zones 20 are both rich in alkylnaphthenes. Alkylnaphthenes are saturated ring structures, including, but not limited to alkylcyclohexanes, alkylcyclopentanes and the like. Under dehydrogenation conditions, the alkylcyclohexanes quickly dehydrogenate to aromatic compounds, which are the foundation for many petrochemical plants. Some of the most widely used plastics, including polyethylene terephthalate ("PET"), are made by converting para-xylene ("p-xylene"), also known as 1,4-dimethylbenzene, to terephthalic acid. To make PET, the terephthalic acid is esterified with ethylene glycol. Creation and isolation of single ring aromatics is advantageous to provide feedstock to petrochemical plants. Recovery of aromatics for p-xylenes is an important step in this process.

Any FCC process is usable to produce the FCC naphtha 20. FCC processes are frequently carried out in a dilute phase using fluidized particles of catalyst. Similarly, the hydrocracker naphtha 22 is obtainable from any hydrocracking process. The naphthas 20, 22 from the FCC and the hydrocracking process are optionally combined, and together, either as separate streams or a combined stream, form a dehydrogenation feedstock 24. The dehydrogenation feedstock 24 is heated in a first charge heating zone 26 to a temperature of about 800° F. (427° C.) to about 1000° F. (538° C.), then directed to a dehydrogenation zone 28. Reactions in a dehydrogenation zone 28 are severely endothermic. During adiabatic operation, the feedstock 24 temperature drops as it proceeds through the dehydrogenation zone 28. The pressure of the dehydrogenator zone 28 is from about 2.5 to about 35 $kg/cm^2$ and the dehydrogenator zone operates at a liquid hourly space velocity of about 0.1 $hr^{-1}$ to about 20 $hr^{-1}$. A reforming catalyst 29, described below, is present in the dehydrogenation zone 28.

In a preferred embodiment, the dehydrogenation zone 28 employs a moving catalyst bed reaction zone and regeneration section 36. The first portion of regenerated catalyst 29 particles is fed to the dehydrogenation reaction zone 28 and the catalyst particles flow downward through the zone by gravity. For the purposes of this invention, "regenerated" catalyst particles 29 are unused catalyst particles, regenerated catalyst particles and mixtures thereof. As the catalyst moves through the beds 28, 32, 40, 80, catalyst particles rub against each other, the reactor interior and the transfer mechanism used to transfer catalyst particles from one reaction zone 28, 32, 40, 80 to another zone or the regenerator 36. The unused catalyst particles are optionally added to replace used parts of the catalyst particles worn away due to erosion. Reference to the catalyst as "regenerated catalyst" or "used catalyst" is intended to include a catalyst that includes fresh replacement catalyst as needed. Replacement catalyst is typically added in amounts of about 0.01 wt % to about 0.10 wt % based on the catalyst circulation rate.

The first portion of regenerated catalyst 29 is withdrawn from the bottom of the dehydrogenation reaction zone 28 and transported to the second reforming zone 32 of the multiple reforming zones 32, 40, 80. Stacking of the multiple reforming zones 32, 40, 80 allows the catalyst 31 to move through the multiple zones by gravity. Preferably, the dehydrogenation zone 28 is also positioned to allow transfer of the catalyst 30 from the dehydrogenation zone 28 to the second reforming zone 32 by gravity. After the catalyst particles 34 have moved through all of the multiple reforming zones 32, 40, 80, the catalyst particles 34 are removed from the bottom of the reaction zone 80 to a regeneration zone 36. Discrete batches of spent catalyst particles 34 are removed from the bottom of the last reforming zone 80 and batches of regenerated catalyst 30 are added to the top of the reaction zones 28, 40. Although catalyst entry and exit from the reaction zones 28, 32, 40, 80 is done using a semi-continuous method, the total catalyst bed acts as if it were continuously moving through the reaction and regeneration zones 36.

As the catalyst particles interact with the feedstock, some reactions cause deposition of carbon on the surface of the catalyst, known as "coking." Moving through the reaction zones, coking of the catalyst becomes progressively more severe due to build up of the coke. In the dehydrogenation 28 and first reforming zones 40, the regenerated catalyst 29, 31 particles become lightly coked. The lightly coked catalyst 42, 43 enters the second reforming zone 32. Additional coke is deposited in the second reforming zone 32 so that, by the time it exits the second reforming zone 32, the catalyst 44 is partially coked. In the third reforming zone 80, coking continues and the partially coked catalyst becomes substantially spent 34. This results in reduced activity of the catalyst due to blocking of the catalytic reaction sites. In the regeneration zone 36, the coke is burned from the spent catalyst 34 and the catalytic activity is restored. The catalyst particles are contacted with hot, oxygen-containing gas, oxidizing the coke to a mixture of carbon monoxide, carbon dioxide and water. Regeneration generally occurs at atmospheric pressure and at temperatures of from about 482° C. to about 538° C. (900-1000° F.), however, localized temperatures within the regeneration zone often range from about 400° C. to about 593° C. (750° F. to about 1100° F.). Regenerated catalyst 30 is recycled back to the dehydrogenation zone 28 and the first reforming zone 40 as the first and second portion of the regenerated catalyst 29, 31. Additional details regarding regeneration of catalyst in a moving bed process is discussed in U.S. Pat. No. 7,858,803, herein incorporated by reference.

A product stream 38 from the dehydrogenation unit 28 is sent to exchange heat in 65 with the feedstock 24 then goes to an aromatics extraction unit 50. In some embodiments, the extraction unit 50 is a UOP SulfolaneTM Process, however, any aromatics extraction process is suitable. An aromatics-rich stream 52 and a raffinate stream 54 are withdrawn from the aromatics extraction unit 50. Regardless of the extractant used, the aromatics-rich stream 52 is sent to an aromatics plant for further processing.

An example of further processing includes conversion of the aromatics to terephthalic acid, followed by esterification of the terephthalic acid to polyethylene terephthalate.

The raffinate 54 from the aromatics extraction process is used as a feedstock to the first catalytic reforming zone 40. The first reforming zone feedstock 56 includes hydrocarbons from $C_6$ to about $C_{12}$ with a boiling point range of from about 82° C. (180° F.) to about 204° C. (399° F.). In the catalytic reforming zones 32, 40, 80, the octane number of the feedstock is increased by dehydrogenation of naphthenes, isomerization of paraffins and paraffin dehydrocyclization. The product of the reforming zone 60, also known as reformate, is frequently used for gasoline blending. In some cases, the reformate 60 is used as a feedstock for an aromatics extraction unit where aromatics are removed for use in petrochemicals.

Straight run naphtha 62 and the raffinate 54 are heated in a second charge heating zone 64, optionally combined and then fed to a first reforming zone 40. The straight run naphtha 62 is typically obtained from the crude distillation tower (not shown), however, it is contemplated that the naphtha be treated in some way. It may, for example, be sent to a hydrotreater to reduce the amount of sulfur or nitrogen in the naphtha. The straight run naphtha 62 and raffinate 54 are optionally combined either prior to entering the second charge heating zone 64, after entering the second change heating zone 64 or after leaving the second charge heating zone 64. The second charge heating zone 64 is optionally a separate zone from the first charge heating zone 26 within the same heating device 66, such as a furnace or kiln. Use of separate heating devices for the first and second charge heating zones 26, 64 is also suitable. The first 72 and second 76 interstage heaters may be housed within the same heating device 66 as the first 26 and second 64 charge heating zones, or the first and second interstage heaters may be in a different heating device (not shown) from the first and second charge heaters or in a different heating device from each other. Temperatures of the raffinate 54 and the straight run naphtha 62 are increased to the range of about 427° C. (800° F.) to about 538° C. (1000° F.).

Reforming zone 32, 40, 80 conditions include pressures from about atmospheric to about 6080 kPaa. In some embodiments, the pressure is from atmospheric to about 2026 kPaa (300 psig), and a pressure below 1013 kPaa (150 psig) is particularly preferred. Hydrogen is generated in a reforming zone 32, 40, 80 by dehydrogenation reactions. However, in some embodiments, additional hydrogen is inserted into the reforming zone 32, 40, 80. The hydrogen is present in each of the reforming zones 32, 40, 80 in amounts of about 0.1 to about 10 moles of hydrogen per mole of hydrocarbon feedstock. The catalyst volume corresponds to a liquid hourly space velocity of from about 0.5 $hr^{-1}$ to about 40 $hr^{-1}$. Operating temperatures are generally in the range from about 260° C. (500° F.) to about 560° C. (1040° F.).

The reforming catalyst used in both the dehydrogenation zone 29 and the reforming zone catalyst 31, 34, 44, is any known reforming catalyst. This catalyst is conventionally a dual-function catalyst that includes a metal hydrogenation-dehydrogenation catalyst on a refractory support. Cracking and isomerization reactions take place on acidic sites of the support material. The refractory support material is preferably a porous, adsorptive, high surface-area material such as silica, alumina, titania, magnesia, zirconia, chromia, thoria, boria or mixtures thereof; clays and silicates which are optionally acid-treated; crystalline zeolite aluminosilicates, either naturally occurring or synthetically prepared, including FAU, MEL, MFI, MOR or MTW (using the IUPAC Commission on Zeolite Nomenclature), in hydrogen form or in a form that has been exchanged with metal cations; non-zeolitic molecular sieves as disclosed in U.S. Pat. No. 4,741,820, herein incorporated by reference; spinels, such as $MgAl_2O_4$, $FeAl_2O_4$, $ZnAl_2O_4$, $CaAl_2O_4$; and combinations of materials from one or more of these groups.

A preferred support material for reforming is alumina with gamma- or eta-alumina being used most frequently. Alumina supports, such as those described as being a by-product of a Ziegler higher alcohol synthesis, known as a "Ziegler alumina," are particularly suitable. Such catalysts are described in U.S. Pat. Nos. 3,852,190 and 4,012,313, hereby incorporated by reference. Ziegler aluminas are available from Vista Chemical Company under the trademark CATAPAL or from Condea Chemie GmbH under the trademark PURAL. This material is an extremely high purity pseudo-boehmite powder, which, after calcination at a high temperature, yields a high-purity gamma-alumina.

An alternate reforming catalyst is a non-acidic L-zeolite, an alkali-metal component and a platinum group metal. To be "non-acidic" the L-zeolite has substantially all of its cationic exchange sites occupied by non-hydrogen atoms. In some embodiments, the cationic exchange sites are occupied by alkali metals, such as potassium. The L-zeolite is composited with a refractory binder to hold it together in a particle form. Any refractory oxide is useful as the binder, including silica, alumina and magnesia. Amorphous silica is particularly useful when made from a synthetic white silica powder precipitated as ultra-fine spherical particles from a water solution. The silica powder is non-acidic, contains less than 0.3% sulfate salts and has a BET surface area of from about 120 $m^2/g$ to about 160 $m^2/g$.

One or more platinum group metals are deposited on the surface of the catalyst. The term "surface" is intended to include, not only the exterior particle surface, but also any surfaces accessible by the reformer feedstock, including surfaces on the interior pores of the support material. The platinum group metal is present as the elemental metal, an oxide, a sulfide, an oxyhalide or in chemical combination with any component of the support material. In some embodiments, the platinum group metal is in a reduced state. When calculated as a weight percentage of the catalytic composite, the platinum group metal is from about 0.01% to about 2.0%, preferably from about 0.05% to about 1.0%.

The reforming catalyst optionally includes one or more additional metal components as are known to modify the activity or selectivity of the catalyst. The additional metal components include, but are not limited to, Group IVA metals, Group VIII metals other than platinum group metals, rhenium, indium, gallium, zinc, uranium, dysprosium, thallium and mixtures thereof. Tin is the additional metal component in at least one embodiment of the invention. The additional metal components are used in catalytically effective amounts and are incorporated onto the reforming catalyst by any method known in the art.

Optionally, the reforming catalyst includes a halogen adsorbed on the catalyst surface to provide an acidic reaction site. Suitable halogens include fluorine, chlorine, bromine, iodine or mixtures thereof. Chlorine is a preferred halogen component. The halogen is generally dispersed over the catalyst surface and is about 0.2% to about 15% of the catalyst by weight calculated on an elemental basis. Details of the catalyst preparation are disclosed in U.S. Pat. No. 4,677,094, herein incorporated by reference.

Many of the reactions taking place in the reforming zones 32, 40, 80, such as dehydrogenation, are endothermic. Unless substantial heat is added to the reactor during processing, the temperature of the fluid passing through the reactor drops in temperature. In an adiabatic system, interstage heating is utilized to maintain reaction at desirable reaction rates. Effluent from the first reforming zone 70 is reheated in a first interstage heating zone 72 prior to introducing it as the feedstock to the second reforming zone 32. Similarly, the effluent from the second reforming zone 74 is reheated in the second interstage heater zone 76 prior to its introduction to the third reforming zone 80.

Although the present process is described in terms of three reforming zones 32, 40, 80, it is to be understood that this method could be used with two, four or even more reforming zones. In each case, the feedstock of each reforming zone 32, 80 beyond the first reforming zone 40 is the reheated effluent of the prior reforming zone. The catalyst entering the second and third reforming zones 43, 44 comes from the previous reforming zone 40, 32 and becomes progressively more covered with coke as it progresses through successive reforming zones. After the final reforming zone 80, the spent catalyst 34 is regenerated. Following regeneration 36, the reforming catalyst 30 again starts moving downward through the reaction zones, beginning in the dehydrogenation zone 28 or the first reforming zone 40, then moving downward through the second 32, third 80, and subsequent reforming zones, if the number of reforming zones exceeds three. After the third or final reforming zone 80, the reformate 60 is optionally separated into multiple products. Typically, the various products are separated at least partly by boiling point. For example, $C_4$-hydrocarbons are often processed with other light ends to recover ethylene and propylene. Single ring aromatics are sent to an aromatics extraction zone where they are recovered. As discussed above, raffinate from aromatics extraction is added to the reformer feedstock for isomerization to naphthenes and dehydrogenation to aromatics.

While particular embodiments of the integrated reforming process have been shown and described, it will be appreciated by those skilled in the art that changes and modifications may be made thereto without departing from the invention in its broader aspects and as set forth in the following claims.

What is claimed is:

1. A method of integrating fluid catalytic cracking product naphtha dehydrogenation with catalytic reforming, the method comprising:

heating a naphtha from a hydrocracking zone and naphtha from a fluid catalytic cracking zone and feeding them to a dehydrogenation zone, the dehydrogenation zone comprising a first portion of regenerated reforming catalyst from a catalyst regenerator;

moving the regenerated reforming catalyst downward through the dehydrogenation zone as it cokes to become lightly coked catalyst;

sending a product stream of the dehydrogenation zone to an aromatics extraction unit;

withdrawing an aromatic-rich extract and a raffinate from the aromatics extraction unit;

heating straight run naphtha and the raffinate and feeding them to a first reforming zone, the first reforming zone comprising a second portion of regenerated reforming catalyst from the catalyst regenerator;

moving the regenerated reforming catalyst downward through the first reforming zone as it starts to become lightly coked catalyst;

removing the lightly coked catalyst from the first reforming zone and the dehydrogenation zone and feeding the lightly coked catalyst from both the first reforming zone and the dehydrogenation zone to the top of the second reforming zone;

heating an effluent from the first reforming zone and feeding it to a second reforming zone;

moving the lightly coked reforming catalyst downward through the second reforming zone as it becomes partially coked reforming catalyst;

removing the partially coked reforming catalyst from the second reforming zone and feeding it to a third reforming zone;

heating an effluent from the second reforming zone and feeding it to the third reforming zone to produce a reformate, the third reforming zone comprising the partially spent reforming catalyst;

moving the partially spent reforming catalyst downward through the third reforming zone as it becomes a substantially spent catalyst;

removing the substantially spent reforming catalyst from the third reforming zone; and regenerating the substantially spent reforming catalyst from the third reforming zone in the catalyst regenerator.

2. The method of claim 1 further comprising separating the reformate into multiple products.

3. The method of claim 1 wherein the reforming catalyst is supported on a crystalline zeolite aluminosilicate, a refractory support material or combinations thereof.

4. The method of claim 1 wherein the reforming catalyst comprises one or more platinum group metals.

5. The method of claim 1 wherein the catalyst moves through the dehydogenator and the reforming zones by gravity.

6. The method of claim 1 wherein the first and second charge heating zones are contained within the same heating device.

7. The method of claim 1 wherein the first and second interstage heating zones are contained within the same heating device.

8. The method of claim 1 wherein the reforming catalyst comprises a dual-function catalyst.

9. The method of claim 1 further comprising removing the reformate from the third reforming zone and separating it into multiple products.

* * * * *